US006983737B2

(12) United States Patent
Gross et al.

(10) Patent No.: US 6,983,737 B2
(45) Date of Patent: Jan. 10, 2006

(54) METHOD, COMPUTER PROGRAM AND CONTROL AND/OR REGULATING DEVICE FOR OPERATING AN INTERNAL COMBUSTION ENGINE

(75) Inventors: Jochen Gross, St. Wendel (DE); Lutz Reuschenbach, Stuttgart (DE); Georg Mallebrein, Korntal-Muenchingen (DE); Eberhard Klein, Plochingen (DE); Michael Drung, Muehlacker (DE); Lionel Martin, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 10 days.

(21) Appl. No.: 10/497,723

(22) PCT Filed: Jul. 24, 2002

(86) PCT No.: PCT/DE02/02724

§ 371 (c)(1),
(2), (4) Date: Jun. 4, 2004

(87) PCT Pub. No.: WO03/048550

PCT Pub. Date: Jun. 12, 2003

(65) Prior Publication Data

US 2004/0260450 A1 Dec. 23, 2004

(30) Foreign Application Priority Data

Dec. 4, 2001 (DE) ..... 101 59 389
May 28, 2002 (DE) ..... 102 23 677

(51) Int. Cl.
*F02M 7/087* (2006.01)

(52) U.S. Cl. ..... 123/435; 123/436; 123/568.11; 701/103; 73/118.2

(58) Field of Classification Search ..... 123/435, 123/436, 568.11, 90.11, 90.12, 90.15; 701/103–105; 73/118.2
See application file for complete search history.

(56) References Cited

U.S. PATENT DOCUMENTS 5,931,140 A * 8/1999 Maloney ..... 123/480
6,272,427 B1 8/2001 Wild et al. ..... 701/108

FOREIGN PATENT DOCUMENTS

| | | |
|---|---|---|
| EP | 0 879 950 | 11/1998 |
| JP | 02 112739 | 7/1990 |
| WO | WO 99 15769 | 4/1999 |

* cited by examiner

*Primary Examiner*—Hai Huynh
(74) *Attorney, Agent, or Firm*—Walter Ottesen

(57) ABSTRACT

An internal combustion engine (10) is operated in dependence upon operating characteristic variables such as rpm (nmot) of a crankshaft (18), temperature (Tmot) of the internal combustion engine (10) and/or temperature of the intake air (Taev). In the method, a temperature (Taevk) of the inducted air in the combustion chamber (16) is, at least in approximation, obtained from a detected or modeled temperature (Taev) of the inducted air in a region remote from the combustion chamber. To simplify the programming, it is suggested that the determination of the temperature (Taevk) of the inducted air in the combustion chamber (16) takes place under the assumption that the inducted air has a modeled or detected initial temperature (Taev) and that the intake air comes into thermal contact with a typical component (22) during a contact time (tcontact) which is typical for a type of the internal combustion engine (10) and for an operating state of the internal combustion engine (10) and the typical component has a modeled or detected temperature (Tev).

12 Claims, 4 Drawing Sheets

METHOD, COMPUTER PROGRAM AND CONTROL AND/OR REGULATING DEVICE FOR OPERATING AN INTERNAL COMBUSTION ENGINE

RELATED APPLICATIONS

This application is the national stage of international application PCT/DE 02/02724, filed Jul. 24, 2002, designating the United States and claiming priority from German patent application Nos. 101 59 389.9, filed Dec. 4, 2001, and 102 23 677.1, filed May 28, 2002, the entire contents of which are incorporated herein by reference.

FIELD OF THE INVENTION

The invention relates first to a method for operating an internal combustion engine in dependence upon operating characteristic variables, such as rpm of a crankshaft, temperature of the internal combustion engine and/or temperature of the intake air. In the method, a temperature of the inducted air in a region close to the combustion chamber or in the combustion chamber itself is obtained, at least in approximation, from a detected or modeled temperature of the inducted air in a region remote from the combustion chamber.

The precise knowledge of the fresh air mass, which is disposed in the combustion chamber, is basically important for the operation of an internal combustion engine. This is used for mixture precontrol. Especially shortly after the start, when a lambda probe, which is used for mixture control, is not yet operationally ready, a precise detection of the air charge is required.

This is possible by means of an air mass sensor or by means of an intake manifold pressure sensor. The intake manifold pressure is, however, a very indirect charge signal. With knowing only the intake manifold pressure, the charge of the combustion chamber with fresh air cannot yet be computed. The knowledge of the temperature of the fresh air, which is inducted into the combustion chamber (without considering the mixing with hot residual gas which is possibly present), is, inter alia, required.

BACKGROUND OF THE INVENTION

From U.S. Pat. No. 6,272,427, it is known that, for otherwise like ambient conditions, a higher temperature of the intake air causes, inter alia, the following: a higher tendency to knock; an improved vaporization of the fuel; a reduced wall film formation of the fuel on the inner walls of the intake manifold; and, a reduction of the inducted air mass and therefore a reduction of the needed fuel quantity. In the context of this background, modern controls for internal combustion engines process the intake air temperature which can be measured by a corresponding sensor or is computed via a corresponding temperature model.

Space reasons in the vicinity of the internal combustion engine are the cause that sensors, with which the temperature of the intake air can be measured, cannot be mounted in the immediate vicinity of the combustion chamber of the internal combustion engine; instead, these sensors are, for example, mounted in the air filter housing, in an air mass sensor, in a throttle flap support or in combination with a sensor for measuring the air pressure in the intake manifold.

In its path into the combustion chamber through the intake manifold, the intake air can become warm on the warm walls of the intake manifold and on other warm or hot parts which lie in the flow path. For this reason, this means that the temperature, which is measured with these sensors, is usually less than the actual temperature of the fresh air, which is enclosed in the combustion chamber after the end of the intake stroke and is not yet mixed with the hot residual gas which possibly is present in the combustion chamber.

For this reason, U.S. Pat. No. 6,272,427 suggests a correction of the measured temperature of the intake air. For this purpose, a weighting factor is used which is computed by means of characteristic lines or characteristic fields in dependence upon the intake air temperature, the engine temperature and an operating point of the internal combustion engine.

SUMMARY OF THE INVENTION

The present invention has the task of providing a method of the type mentioned initially herein which is so improved that it can be more easily programmed and supplies more precise results.

This task is solved with a method of the kind mentioned initially herein in that the determination of the temperature of the inducted air in the region near the combustion chamber or in the combustion chamber itself takes place under the assumption that the intake air has a modeled or detected initial temperature and that the intake air comes into thermal contact with a typical component during a contact time, which is typical for the type of internal combustion engine and for an operating state of the internal combustion engine, and the typical component has a modeled or detected temperature.

In the method according to the invention, the application of complex characteristic lines or complex characteristic fields is substantially unnecessary because the correction of the temperature of the inducted air takes place essentially on the basis of physical laws and mathematical formulations. These are considerably simpler to apply or to program than characteristic lines or characteristic fields. Furthermore, the consideration of the physical laws permits achieving a more precise computation result.

The method of the invention is based on several assumptions.

On the one hand, it is assumed in a simplifying manner that the warming of the inducted fresh air is affected by the contact with a typical component, which lies upstream of the combustion chamber, or at least a structural part of the internal combustion engine which lies upstream from the combustion chamber. This component or this structural part represents all warm components and structural parts of the internal combustion engine which lie in the flow path of the intake air.

Furthermore, it is assumed that the temperature increase of the fresh air takes place in advance of a possible mixing with hot residual gases in the intake manifold or in the combustion chamber. Furthermore, it is assumed that the heat quantity, which is transferred to the inducted fresh air (or, in rare cases, the heat quantity transferred from the inducted fresh air), is dependent upon the contact time, which is typical for a type of internal combustion engine, between the inducted fresh air and the structural part, which gives up the heat, or the structural parts which give up the heat. These assumptions correspond in the same way to the conditions in an RC-member in electrical engineering. There, the typical contact time would be realized by the "closed time" of an on/off switch.

On the basis of the assumptions in accordance with the invention, a differential equation of the first order results whose solution yields an exponential dependency of the temperature of the inducted air on the typical contact time.

The contact time, which is typical for an internal combustion engine type, can, in turn, be empirically determined in a simple manner. With the method of the invention, it is therefore possible to compute the warming of the fresh air inducted by an internal combustion engine based on the usual thermal equations without it being necessary to program complicated characteristic lines or characteristic fields.

First, it is suggested that the contact time, which is typical for a specific type of internal combustion engine, be obtained with the aid of test runs of the type of internal combustion engine at varying operating conditions, especially cold and warm internal combustion engines. Also, test runs with cold and warm intake air are possible. This is a procedure which has shown very good results in practice. In general, the typical contact time is inversely proportional to the rpm of the crankshaft. With the above test runs, the corresponding proportionality constant can be determined in a simple manner. Usually, the typical contact time would lie in the range of the duration of one intake stroke because the heat transfer is much greater for a flowing fluid than for a fluid at standstill.

In an advantageous configuration of the method of the invention, it is also suggested that the determination of the temperature of the inducted air takes place in the region near the combustion chamber or in the combustion chamber itself under the assumption that the heat quantity (which is exchanged between the inducted air and the typical component of the internal combustion engine with which the inducted air enters into thermal contact) is dependent upon a difference between the temperature, which is measured in a region remote from the combustion chamber, or the modeled temperature of the inducted air and the temperature of the typical components of the internal combustion engine with which the inducted air enters into thermal contact.

In this embodiment of the method of the invention, and in addition to the dependency of the exchanged heat quantity on the contact time, the dependency is also considered of the exchanged heat quantity on the temperature difference between the flowing fresh air and the at least one component. The precision for the determination of the warming of the inducted fresh air is again significantly improved in this way.

Preferably, the temperature of at least one inlet valve is used as the temperature of the component of the internal combustion engine. This is based on the thought that the inducted fresh air is heated on its path to the combustion chamber especially by the very hot inlet valve or its components. This assumption makes possible a very simple computation and nonetheless permits a high reliability of the determined temperature of the intake air.

Here, it is, in turn, preferred when the temperature of the inlet valve is obtained from a measured temperature of a coolant and/or of a cylinder head. The coolant temperature as well as the cylinder head temperature are determined in conventional internal combustion engines anyhow by means of sensors. Based on simple computation models, which consider the heat conductivity from the location of the temperature measurement to the inlet valve, the temperature of the inlet valve can be determined with great accuracy. In the simplest case, the temperature of the inlet valve can be set equal to the measured temperature without the temperature result being significantly falsified thereby.

In a four-stroke internal combustion engine, the temperature of the inducted air in the region near the combustion chamber or in the combustion chamber itself is preferably determined by the following formula:

$$Taevk = Taev + (Tev - Taev) * \left(1 - e^{\frac{-15\ [\mathrm{sec/min}]}{nmot\ [1/\mathrm{min}] * tcontact\ [\mathrm{sec}]}}\right)$$

wherein:

Taevk=corrected temperature of the intake air;

Taev=detected or modeled temperature of the inducted air in a region remote from the combustion chamber;

Tev=detected or modeled temperature of a component of the internal combustion engine;

nmot=detected rpm of the crankshaft of the engine;

tcontact=typical contact time wherein the inducted air warms by (1−1/e)*(Tev−Taev).

The typical contact time is a time constant wherein the inflowing gas is warmed by a specific amount of the difference temperature between the gas and the component. As the decisive variable in the exponent of the e-function, there remains only the rpm of the crankshaft of the internal combustion engine. With this simple formula, which is therefore also easy to program, the corrected temperature of the intake air can be determined with a high precision. Only the conditions at which the typical contact time is applicable must be determined, for example, by an experiment.

It is also possible that, in a four-stroke internal combustion engine, the determination of the temperature of the inducted air in the region near the combustion chamber or in the combustion chamber itself is determined in accordance with the following formula:

$$Taevk = Taev + (Tev - Taev) * \left(1 - e^{\frac{-NMOTWK\ [1/\mathrm{min}]}{nmot\ [1/\mathrm{min}]}}\right)$$

wherein:

Taevk=corrected temperature of the intake air;

Taev=detected or modeled temperature of the inducted air in a region remote from the combustion chamber;

Tev=detected or modeled temperature of a component of the internal combustion engine;

nmot=detected rpm of the crankshaft of the internal combustion engine;

NMOTWK=typical rpm of the crankshaft of the internal combustion engine at which the inducted air warms by (1−1/e)*(Tev−Taev).

In the same way as the above formula, it also applies here that this formula supplies precise results and is easy to program. The use of a typical rpm permits a still simpler computation. The formula can likewise be determined by test runs. For example, two curves can be determined which describe the dependency of the inducted fresh air mass on the pressure in the intake manifold at a typical rpm and different temperatures of the inducted air. The equation is made usable for a typical rpm.

That embodiment of the method of the invention is especially advantageous wherein the temperature of the inducted air in the region near the combustion chamber or in the combustion chamber itself is used for determining the fresh air charge disposed in the combustion chamber at the end of an induction stroke. The fresh air charge is, in turn, used in order to precontrol the fuel quantity to be injected into the combustion chamber. Finally, the method of the invention makes possible that the air/fuel mixture present in the combustion chamber can be adjusted very precisely in the desired manner.

For this purpose, it is provided in accordance with the invention that the charge of the combustion chamber is determined based on the following equation:

$$rffg = FUPSRLROH * \frac{273\ \mathrm{K}}{Taevk} * \left(ps - \frac{rfrg * Trgk}{FUPSRLROH * 273\ \mathrm{K}}\right)$$

wherein:

rffg=freshly inducted air charge;

FUPSRLROH=variable dependent upon operating point;

rfrg=normalized residual gas charge referred to the piston displacement;

Taevk=corrected temperature of the inducted air;

ps=pressure in the intake manifold;

Trgk=temperature of the residual gas in (K) expanded to the intake manifold pressure but assumed idealistically unmixed.

The above-mentioned equation is also characterized as the equation of the adiabatic charge exchange model. The factor FUPSRLROH is an operating point dependent variable but independent from the intake manifold pressure and the temperature and this variable describes the slope of the characteristic line rl=f(ps) at constant rfrg and Trg (dependency of the inducted fresh air mass on the pressure in the intake manifold). The equation considers all effects of the charge exchange. Here, the influence of the heat transfer from components of the internal combustion engine to the fresh air are considered only with the aid of the variable Taevk. Based on the intake pressure, which is usually detected by a pressure sensor in the intake manifold, the fresh air charge can be determined with high precision without an air mass sensor being necessary.

The invention relates also to a computer program which is suitable for carrying out the method when the computer program is run on a computer. It is preferred when the computer program is stored in a memory, especially in a flash memory.

The subject matter of the present invention is also a control apparatus (open loop and/or closed loop) for operating an internal combustion engine. Here, it is preferred when the apparatus includes a memory on which a computer program of the above type is stored.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
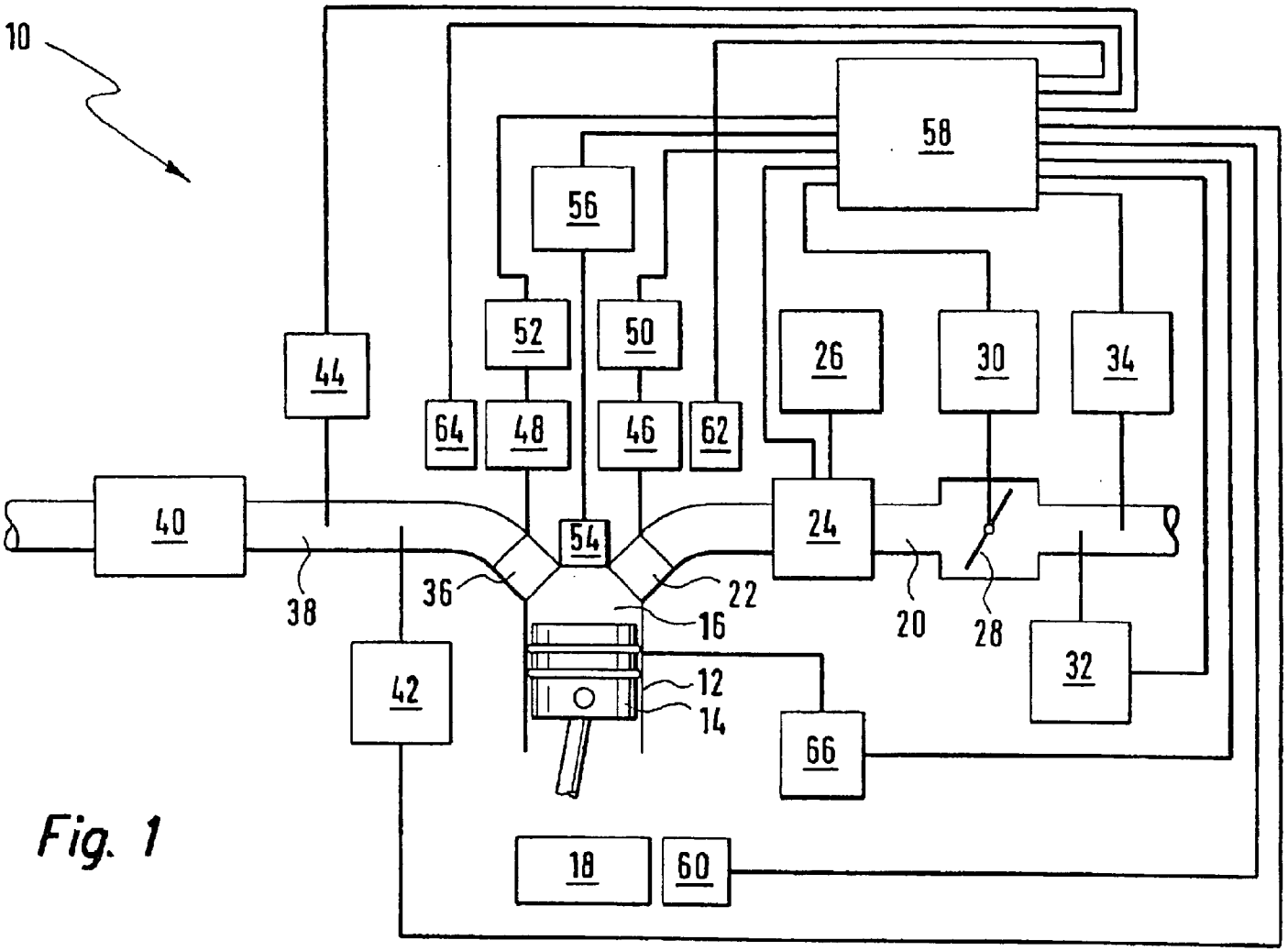
FIG. 1 is a schematic illustration of an internal combustion engine with some of its components.

In FIG. 1, an internal combustion engine has the reference numeral 10. The engine includes several cylinders of which only that having reference numeral 12 can be seen in FIG. 1. In the cylinder, a piston 14 is slidingly guided which delimits a combustion chamber 16 The piston 14 is connected to a crankshaft 18 via a connecting rod (no reference numeral). The crankshaft 18 is only shown symbolically.

Fresh air is supplied to the combustion chamber 16 via an intake manifold 20 and an inlet valve 22. In the intake manifold 20, an injection nozzle 24 is provided which is connected to a fuel system 26. In the intake manifold 20, a throttle flap 28 is mounted upstream of the injection nozzle 24. The throttle flap 28 can be moved into a desired position by an actuating motor 30. The temperature of the supplied fresh air is detected by a sensor 32 and the pressure of the supplied fresh air is detected by a sensor 34 upstream of the throttle flap 28.

The hot exhaust gases are conducted away from the combustion chamber 16 via an outlet valve 36 and an exhaust-gas pipe 38. A catalytic converter 40 purifies the exhaust gases. Between the outlet valve 36 and the catalytic converter 40, the temperature of the exhaust gas is detected by a temperature sensor 42 and the pressure of the exhaust gas is detected by a pressure sensor 44.

The internal combustion engine 10 has a double continuous camshaft control. This means that the closing time points and opening time points of the inlet valve 22 and the outlet valve 36 can be adjusted continuously. For this purpose, the inlet valve 22 is actuated by an inlet camshaft 46 and the outlet valve 36 is actuated by an outlet camshaft 48. The camshafts 46 and 48 are so adjusted during operation by actuators 50 and 52 that the desired closing time points or opening time points are present.

The air/fuel mixture, which is present in the combustion chamber 16 of the internal combustion engine 10, is ignited by a spark plug 54 which, in turn, is driven by an ignition system 56.

The operation of the internal combustion engine 10 is controlled (open loop and/or closed loop) by a control apparatus (open loop and/or closed loop) 58. The control apparatus 58 is connected at the input end to the temperature sensor 32 and the pressure sensor 34 in the intake manifold 20. In addition, the control apparatus receives signals from the temperature sensor 42 and the pressure sensor 44 in the exhaust-gas pipe 38. A transducer 60 supplies signals from which the rpm of the crankshaft 18 and its angular position can be obtained.

In the same manner, sensors 62 and 64 are provided which detect the angular position of the inlet camshaft 46 or the outlet camshaft 48. At the output end, the control apparatus 58 is connected to the following: the injection nozzle 24; the actuating motor 30 of the throttle flap 28; the actuators 50 and 52 of the inlet camshaft 46 and of the outlet camshaft 48, respectively; and, to the ignition system 56. A temperature sensor 66 detects the temperature of a cylinder head (not shown) of the internal combustion engine 10.

In order to be able to determine that fuel quantity which corresponds to the torque wanted by the operator of the internal combustion engine 10 and for which the wanted mixture composition in the combustion chamber 16 is obtained, it is necessary to determine the quantity of the fresh air arriving in the combustion chamber 16 in a work cycle.

For this purpose, a sensor could also be utilized; however, the sensor is not used because of cost reasons when, as here, a pressure sensor 34 is present in the intake manifold 20. In an embodiment not shown, an air mass sensor is installed in the intake manifold in lieu of the pressure sensor. In this case, the pressure in the intake manifold would have to be determined for determining the air charge of the combustion chamber from the detected signals.

Figure 2:
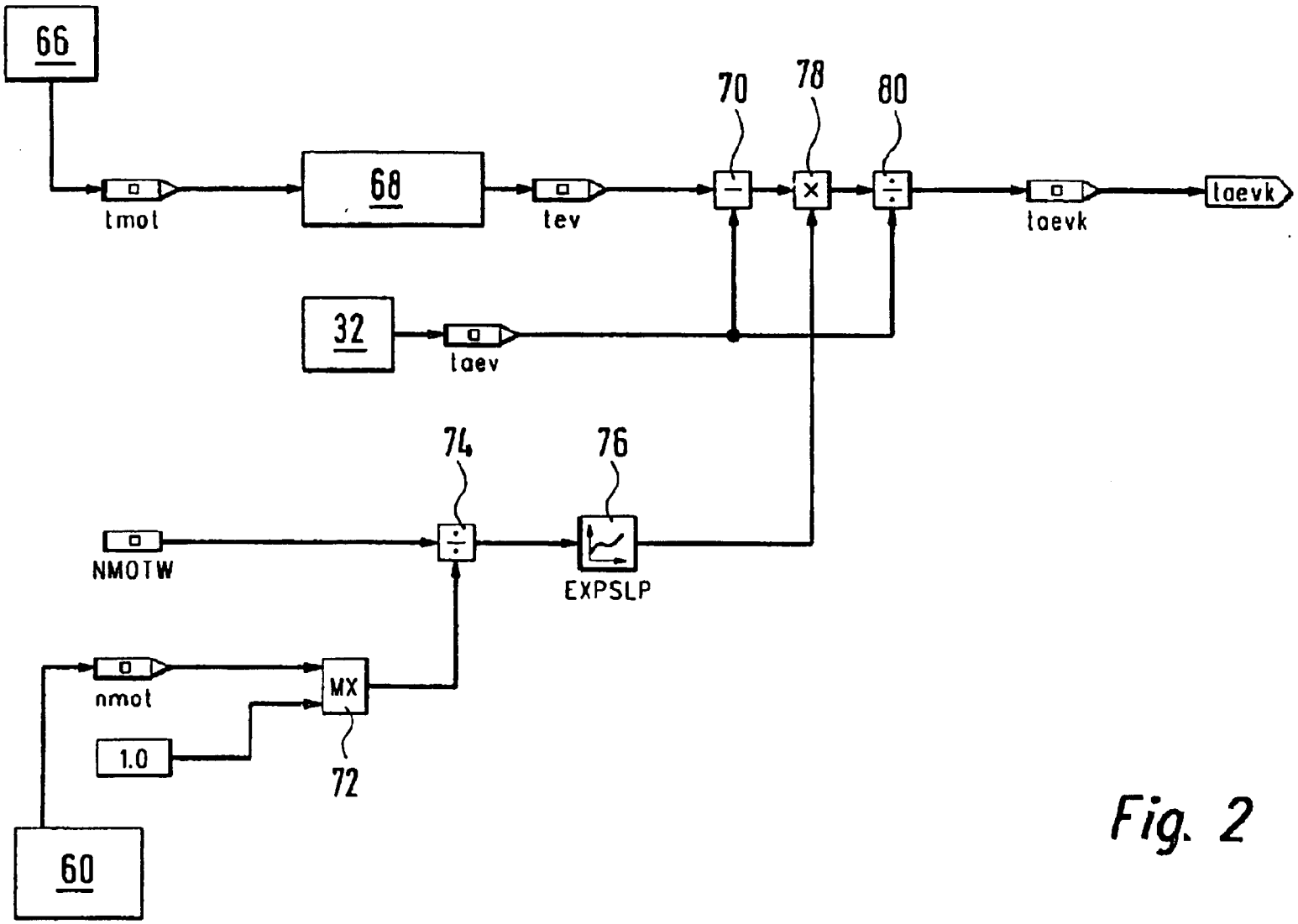
FIG. 2 is a flowchart which describes a method for correcting an intake air temperature of the internal combustion engine of FIG. 1.

As shown in FIG. 2, the signal of the temperature sensor 66 is fed into a processing block 68. In block 68, based on a numerical model, the temperature Tev of the inlet valve 22 is determined from the temperature Tmot of the cylinder head. With such a model, a temperature of the intake manifold 20 could also be easily overall determined with this temperature being typical for the present computation. The inlet valve 22 is a typical component insofar as it represents, for the present type of internal combustion engines (10), the warm components of the internal combustion engine 10 which are typical for the warming of the intake air.

From a temperature Tans of the inducted air, which is detected by the sensor 32, a temperature Taev is determined based on a numerical model in a processing block (not shown). Here, the temperature Taev is that temperature which the inflowing air exhibits in a region lying upstream of the inlet valve 22 and which region is insofar remote from the combustion chamber. However, in most operating states of the internal combustion engine 10, the temperature Taev is higher than Tans because the inflowing air is already somewhat warmed by the contact with the components disposed in the intake manifold. It is, however, assumed in the modeling that a warming of the inflowing gas does not take place because of possibly backflowing gas. At 70, the difference between the temperature Tev of the inlet valve 22 and the temperature Taev of the inducted air is formed.

The value nmot of the rpm of the crankshaft 18, which is made available by the sensor 60, is compared in 72 to the value 1 and the value which is higher is outputted. The output of block 72 is used as a divider in a division block 74. Because of the comparison in 72, it is prevented that the divider assumes the value 0.

A constant NMOTW is fed into the division block 74 as the quantity which is to be divided. This constant is an applicable rpm value which describes the intensity of the heat contact of the inducted fresh air with the inlet valve 22. Here, NMOTW is a typical engine rpm for which the inducted air warms by the amount $1/e^{(Tev-Taev)}$ when flowing into the combustion chamber 16. NMOTW corresponds to a normalized contact time which is typical for a specific type of internal combustion engine and a specific operating state. This contact time will be discussed in detail hereinafter. The contact time is determined empirically. At higher rpms, the temperature adaptation is less.

Figure 3:
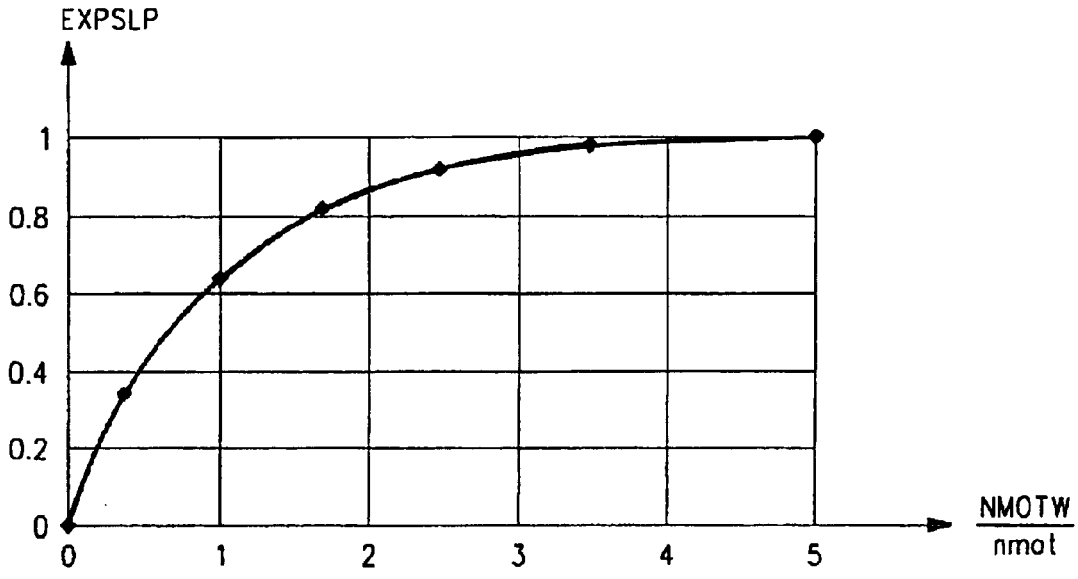
FIG. 3 is a diagram of a function which is used in the method for correcting the intake air temperature in FIG. 2; and, FIG. 4 is a function diagram which shows a method for computing a fresh air charge by means of a corrected intake air temperature.

The output of the division block 74 is fed into a characteristic line EXPSLP which is identified in FIG. 2 by reference numeral 76. This characteristic line is also shown in FIG. 3. The following function is reflected in this characteristic line:

$$x = 1 - e^{-\frac{NMOTWK}{nmot}}$$

The output of the characteristic line EXPSLP in block 76 is fed into a multiplier 78 and the difference, which is formed in 70, is fed into the multiplier 78. This difference is between the temperature Tev of the inlet valve 22 and the temperature Taev of the intake air. The output of the block 78 is added in 80 to the temperature Taev of the intake air and the result is outputted as the corrected intake air Taevk.

The corrected temperature Taevk is, to a very close approximation, the temperature of the fresh air enclosed at the end of the intake stroke in the combustion chamber 16 of the internal combustion engine 10 (that is, in the closest possible region to the combustion chamber). The sequence shown in FIG. 2 corresponds to a processing of the formula:

$$Taevk = Taev + (Tev - Taev) * \left(1 - e^{\frac{-NMOTWK\ [1/\min]}{nmot\ [1/\min]}}\right)$$

This formula considers that the determination of the fresh air present in the combustion chamber takes place after the end of the intake stroke while utilizing a so-called "typical contact time". This contact time is determined for a specific type of internal combustion engine and a specific operating state by experiments, for example, test runs of the internal combustion engine in the cold and warm states. Often, this contact time corresponds approximately to that time span during which the inducted fresh air flows past at the hot inlet valve 22 before it reaches the combustion chamber 16 itself. In the present embodiment, the contact time is approximately equal to the duration of one intake stroke. The typical rpm NMOTWK is determined from the typical contact time via a normalization with the rpm for which the typical contact time was determined.

In addition, for the determination of the temperature of the fresh air present in the combustion chamber 16 at the end of the intake stroke, the difference is also considered between the temperature of the inducted air, which is measured by the temperature sensor 32, and the temperature Tev of the injection valve 22, which is modeled from the temperature Tmot of the cylinder head of the internal combustion engine 10.

Figure 4:
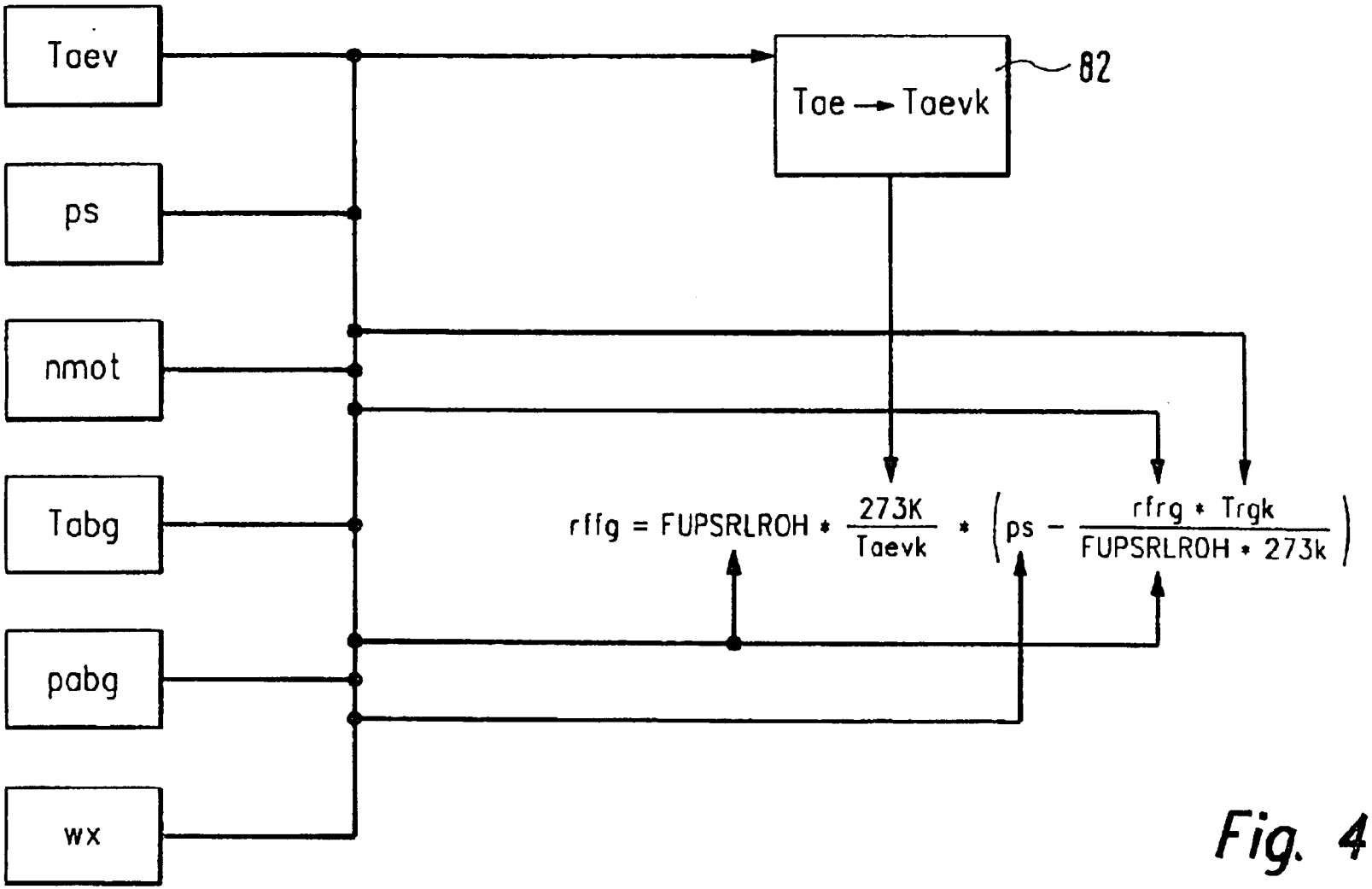

As shown in FIG. 4, the temperature Taevk of the fresh air, which is enclosed in the combustion chamber 16 at the end of the intake stroke, is used for the determination of a relative charge of the combustion chamber 16 with fresh air. The temperature Taevk is determined in the manner described above. In the formula given in FIG. 4, this fresh air charge is identified by rffg. Here, rffg=100% when the piston displacement of the combustion chamber 16 is filled with fresh air at a pressure of 1013.25 hPa and 273.15 K.

The signals, which are detected by the sensors 32, 34, 60, 42, 44, 62 and 64, are inserted directly or indirectly into the formula given in FIG. 4. These signals are: Taev (temperature of the inducted fresh air), ps (pressure in the intake manifold), nmot (rpm of the crankshaft 18), Tabg (exhaust gas temperature), pabg (pressure of the exhaust gas in the exhaust-gas pipe 38) and wx (specific angular positions of the crankshaft 18 as well as the inlet camshaft 46 and the outlet camshaft 48). The corrected temperature of the fresh air present in the combustion chamber is determined from the temperature Taev of the inducted fresh air in a block 82 in accordance with the diagram of FIG. 2.

The formula, which is presented in FIG. 4, considers also, as needed, residual gas present at the end of the intake stroke in the combustion chamber 16 Such a residual gas is present in the combustion chamber 16 when the internal combustion engine 10 has an internal or external exhaust-gas recirculation. In the formula presented in FIG. 4, the residual gas is considered by the variable rfrg which is the relative charge of the combustion chamber 16 with residual gas. Here, rfrg=100% when the piston displacement of the combustion chamber 16 is filled with residual gas at a pressure of 1013.25 hPA and a temperature of 273.15 K.

The variable Trgk is the mean temperature of the total residual gas under the assumption that it is expanded (unthinned with fresh air) to the pressure ps present in the intake manifold 20. The factor FUPSRLROH is an operating point dependent quantity independent, however, from the pressure ps in the intake manifold 20 and from the temperature Taev of the inducted fresh air. For constant rfrg (relative charge of residual gas) and Trg (mean temperature residual gas), FUPSRLROH describes the slope of a characteristic line which couples the relative charge of the combustion chamber 16 with the fresh air to the pressure ps in the intake manifold 20.

What is claimed is:

1. A method for operating an internal combustion engine in dependence upon operating characteristic variables including at least one of: rpm (nmot) of a crankshaft; temperature (Tmot) of the internal combustion engine; and, temperature of the intake air (Taev); the method comprising the steps of:

obtaining a temperature (Taevk) of the inducted air in a region near the combustion chamber or in the combustion chamber itself at least approximately from a detected or modeled temperature (Taev) of the inducted air in a region remote from the combustion chamber;

determining the temperature (Taevk) of the inducted air in the region near the combustion chamber or in the combustion chamber itself under the assumption that the inducted air has a modeled or detected initial temperature (Taevk);

bringing the intake air into thermal contact with a typical component during a contact time (tcontact) which is typical for a type of the internal combustion engine and for an operating state of the internal combustion engine with the typical component being a modeled or detected temperature (Tev); and, utilizing at least an inlet valve, a cylinder head or a coolant as said typical component.

2. The method of claim 1, wherein the contact time (tcontact), which is typical for a specific type of internal combustion engine, is obtained with the aid of test runs of the internal combustion engine type at different operating conditions including cold and warm internal combustion engines.

3. The method of claim 1, wherein the temperature (Taevk) of the inducted air in the region near the combustion chamber or in the combustion chamber itself is dependent upon a difference between the temperature (Taev) of the inducted air and the temperature (Tev) of the typical component of the internal combustion engine with which the inducted air comes into thermal contact, the temperature (Taev) being modeled or measured in a region remote from the combustion chamber.

4. The method of claim 3, wherein the modeled or detected temperature (Tev) of at least one inlet valve is used as the temperature of the component of the internal combustion engine.

5. The method of claim 4, wherein the temperature (Tev) of the inlet valve is obtained from a measured temperature (Tmot) of a coolant and/or of a cylinder head.

6. The method of claim 1, wherein, for a four-stroke internal combustion engine, the temperature (Taevk) of the inducted air is determined in the region near the combustion chamber or in the combustion chamber itself in accordance with the following formula:

$$Taevk = Taev + (Tev - Taev) * \left(1 - e^{\frac{-15\ [\mathrm{sec/min}]}{nmot\ [1/\mathrm{min}] * tcontact\ [\mathrm{sec}]}}\right)$$

wherein:

Taevk=corrected temperature of the inducted air;

Taev detected or modeled temperature of the inducted air in a region remote from the combustion chamber;

Tev=detected or modeled temperature of a component of the internal combustion engine;

nmot=detected rpm of the crankshaft of the internal combustion engine; and, tcontact=typical contact time during which the inducted air is warmed by (1−1/e)*(Tev-Taev).

7. The method of claim 1, wherein, in a four-stroke internal combustion engine, the determination of the temperature (Taevk) of the inducted air in the region near the combustion chamber or in the combustion chamber itself is determined in accordance with the following formula:

$$Taevk = Taev + (Tev - Taev) * \left(1 - e^{\frac{-NMOTWK\ [1/\mathrm{min}]}{nmot\ [1/\mathrm{min}]}}\right)$$

wherein:

Taevk=corrected temperature of the inducted air;

Taev=detected or modeled temperature of the inducted air into a region remote from the combustion chamber;

Tev=detected or modeled temperature of a component of the internal combustion engine;

nmot=detected rpm of the crankshaft of the internal combustion engine; and,

NMOTWK=typical rpm of the crankshaft of the internal combustion engine at which the inducted air is warmed by (1−1/e)*(Tev-Taev).

8. The method of claim 1, wherein the temperature (Taevk) of the inducted air in the region near the combustion chamber or in the combustion chamber itself is used for determining the fresh air charge (rffg) disposed in the combustion chamber at the end of an induction stroke.

9. The method of claim 8, wherein the charge (rffg) of the combustion chamber is determined in accordance with the following equation:

$$rffg = FUPSRLROH * \frac{273\ \mathrm{K}}{Taevk} * \left(ps - \frac{rfrg * Trgk}{FUPSRLROH * 273\ \mathrm{K}}\right)$$

wherein:

rffg=freshly inducted air charge;

FUPSRLROH=operating point dependent variable;

rfrg=residual gas charge normalized and referred to piston displacement;

Taevk=corrected temperature of the inducted air;

ps=pressure in the intake manifold; and,

Trgk=temperature in (K) of the residual gas expanded to the intake manifold pressure but assumed idealized unmixed.

10. A computer program comprising a program for carrying out a method when executed on a computer, the method being for operating an internal combustion engine in dependence upon operating characteristic variables including at least one of: rpm (nmot) of a crankshaft; temperature (Tmot) of the internal combustion engine; and, temperature of the intake air (Taev); and the method including the steps of:

obtaining a temperature (Taevk) of the inducted air in a region near the combustion chamber or in the combustion chamber itself at least approximately from a detected or modeled temperature (Taev) of the inducted air in a region remote from the combustion chamber;

determining the temperature (Taevk) of the inducted air in the region near the combustion chamber or in the combustion chamber itself under the assumption that the inducted air has a modeled or detected initial temperature (Taevk);

bringing the intake air into thermal contact with a typical component during a contact time (tcontact) which is typical for a type of the internal combustion engine and for an operating state of the internal combustion engine with the typical component being a modeled or detected temperature (Tev); and, utilizing at least an inlet valve, a cylinder head or a coolant as said typical component.

11. The computer program of claim 10, wherein the computer program is stored in a memory including in a flash memory.

12. A control apparatus (open loop and/or closed loop) for operating an internal combustion engine, the control apparatus comprising a memory on which a computer program is stored with said computer program being for carrying out a method for operating an internal combustion engine in dependence upon operating characteristic variables including at least one of: rpm (nmot) of a crankshaft; temperature (Tmot) of the internal combustion engine; and, temperature of the intake air (Taev); and the method including the steps of:

obtaining a temperature (Taevk) of the inducted air in a region near the combustion chamber or in the combustion chamber itself at least approximately from a detected or modeled temperature (Taev) of the inducted air in a region remote from the combustion chamber;

determining the temperature (Taevk) of the inducted air in the region near the combustion chamber or in the combustion chamber itself under the assumption that the inducted air has a modeled or detected initial temperature (Taevk);

bringing the intake air into thermal contact with a typical component during a contact time (tcontact) which is typical for a type of the internal combustion engine and for an operating state of the internal combustion engine with the typical component being a modeled or detected temperature (Tev); and, utilizing at least an inlet valve, a cylinder head or a coolant as said typical component.

* * * * *